US008452034B2

(12) United States Patent
Theverapperuma

(10) Patent No.: US 8,452,034 B2
(45) Date of Patent: May 28, 2013

(54) ENTRAINMENT AVOIDANCE WITH A GRADIENT ADAPTIVE LATTICE FILTER

(75) Inventor: Lalin Theverapperuma, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 1236 days.

(21) Appl. No.: 11/877,317

(22) Filed: Oct. 23, 2007

(65) Prior Publication Data

US 2008/0130926 A1 Jun. 5, 2008

Related U.S. Application Data

(60) Provisional application No. 60/862,533, filed on Oct. 23, 2006.

(51) Int. Cl.
*H04R 25/00* (2006.01)

(52) U.S. Cl.
USPC ..... 381/313; 381/95; 381/96; 381/108; 381/317; 381/318; 381/320; 381/71.11; 381/71.12; 381/321; 381/322

(58) Field of Classification Search
USPC ..... 381/312, 93, 83
See application file for complete search history.

(56) References Cited

U.S. PATENT DOCUMENTS

| | | | |
|---|---|---|---|
| 3,601,549 | A | 8/1971 | Mitchell |
| 4,495,643 | A | 1/1985 | Orban |
| 4,731,850 | A | 3/1988 | Levitt et al. |
| 4,783,817 | A | 11/1988 | Hamada et al. |
| 4,879,749 | A | 11/1989 | Levitt et al. |
| 5,016,280 | A | 5/1991 | Engebretson et al. |
| 5,502,869 | A | 4/1996 | Smith et al. |
| 5,533,120 | A | 7/1996 | Staudacher |
| 5,619,580 | A | 4/1997 | Hansen |
| 5,621,802 | A | 4/1997 | Harjani et al. |
| 5,668,747 | A | 9/1997 | Ohashi |
| 6,072,884 | A | 6/2000 | Kates |
| 6,173,063 | B1 | 1/2001 | Melanson |
| 6,219,427 | B1 | 4/2001 | Kates et al. |
| 6,356,606 | B1 | 3/2002 | Hahm |
| 6,389,440 | B1 | 5/2002 | Lewis et al. |

(Continued)

FOREIGN PATENT DOCUMENTS

| | | | |
|---|---|---|---|
| DE | 19748079 | A1 | 5/1999 |
| EP | 0585976 | A2 | 3/1994 |

(Continued)

OTHER PUBLICATIONS

Haykin, S. "Adaptive Filter Theory: 3rd Edition", Prentice Hall: Upper Saddle River, N.J 1996, pp. 915-918.*

(Continued)

*Primary Examiner* — Steven Loke
*Assistant Examiner* — Cuong Nguyen
(74) *Attorney, Agent, or Firm* — Schwegman Lundberg & Woessner, P.A.

(57) ABSTRACT

Method and apparatus for signal processing an input signal in a hearing assistance device to avoid entrainment, the hearing assistance device including a receiver and a microphone, the system comprising using a gradient adaptive lattice filter including one or more reflection coefficients to measure an acoustic feedback path from the receiver to the microphone of the hearing assistance device.

16 Claims, 5 Drawing Sheets

U.S. PATENT DOCUMENTS

| | | | | |
|---|---|---|---|---|
| 6,434,247 | B1 * | 8/2002 | Kates et al. | 381/312 |
| 6,480,610 | B1 | 11/2002 | Fang et al. | |
| 6,494,247 | B1 | 12/2002 | Pedone | |
| 6,498,858 | B2 | 12/2002 | Kates | |
| 6,552,446 | B1 | 4/2003 | Lomba et al. | |
| 7,058,182 | B2 | 6/2006 | Kates | |
| 7,065,486 | B1 | 6/2006 | Thyssen | |
| 7,519,193 | B2 | 4/2009 | Fretz | |
| 7,809,150 | B2 | 10/2010 | Natarajan et al. | |
| 8,199,948 | B2 | 6/2012 | Theverapperuma | |
| 2001/0002930 | A1 | 6/2001 | Kates | |
| 2003/0026442 | A1 | 2/2003 | Fang et al. | |
| 2003/0031314 | A1 * | 2/2003 | Tanrikulu et al. | 379/406.01 |
| 2003/0185411 | A1 * | 10/2003 | Atlas et al. | 381/98 |
| 2004/0086137 | A1 | 5/2004 | Yu et al. | |
| 2004/0125973 | A1 | 7/2004 | Fang et al. | |
| 2005/0036632 | A1 * | 2/2005 | Natarajan et al. | 381/93 |
| 2005/0047620 | A1 | 3/2005 | Fretz | |
| 2006/0140429 | A1 | 6/2006 | Klinkby et al. | |
| 2007/0223755 | A1 | 9/2007 | Salvetti et al. | |
| 2008/0095388 | A1 | 4/2008 | Theverapperuma | |
| 2008/0095389 | A1 | 4/2008 | Theverapperuma | |
| 2008/0130927 | A1 | 6/2008 | Theverapperuma et al. | |
| 2009/0175474 | A1 | 7/2009 | Salvetti et al. | |
| 2011/0091049 | A1 | 4/2011 | Salvetti et al. | |
| 2011/0116667 | A1 | 5/2011 | Harikrishna et al. | |
| 2012/0230503 | A1 | 9/2012 | Theverapperuma | |

FOREIGN PATENT DOCUMENTS

| | | | |
|---|---|---|---|
| EP | 1367857 | A1 | 12/2003 |
| EP | 1718110 | A1 | 2/2006 |
| EP | 2080408 | B1 | 8/2012 |
| WO | WO-0106746 | A2 | 1/2001 |
| WO | WO-0106812 | A1 | 1/2001 |
| WO | WO-0110170 | A2 | 2/2001 |
| WO | WO-2004105430 | A1 | 12/2004 |
| WO | WO-2008051569 | A2 | 5/2008 |
| WO | WO-2008051569 | A3 | 5/2008 |
| WO | WO-2008051570 | A1 | 5/2008 |
| WO | WO-2008051571 | A1 | 5/2008 |

OTHER PUBLICATIONS

"Advance Adaptive Feedback Cancellation", *IntriCon: Technology White Paper*, [Online], Retrieved from the Internet: <URL: http://www.intricondownloads.com/D1/techdemo/WP_Advanced_AFC_rev101006.pdf>, (Oct. 10, 2005), 3 pg.

"Entrainment (Physics)", [Online]. Retrieved from the Internet: <URL: http://en.wikipedia.org/w/index.php?title=Entrainment_(physics)&printable=yes>, (Jun. 18, 2009), 2 pgs.

"Inspiria Ultimate—GA3285", [Online]. Retrieved from the Internet: <URL: http://www.sounddesigntechnologies.com/products_InspiriaUltimate.php>, (Jun. 18, 2009), 4 pgs.

"U.S. Appl. No. 10/857,599, Final Office Action mailed Jun. 11, 2009", 7 pgs.

"U.S. Appl. No. 10/857,599, Final Office Action Mailed Jul. 24, 2008", 9 pgs.

"U.S. Appl. No. 10/857,599, Non-Final Office Action mailed Jan. 26, 2010", 8 pgs.

"U.S. Appl. No. 10/857,599, Non-Final Office Action mailed Dec. 26, 2007", 8 pgs.

"U.S. Appl. No. 10/857,599, Non-Final Office Action mailed Dec. 31, 2008", 6 pgs.

"U.S. Appl. No. 10/857,599, Notice of Allowance mailed Jul. 26, 2010", 10 pgs.

"U.S. Appl. No. 10/857,599, Response filed Apr. 26, 2010 to Non Final Office Action mailed Jan. 26, 2010", 8 pgs.

"U.S. Appl. No. 10/857,599, Response filed Apr. 28, 2008 to Non-Final Office Action mailed Dec. 26, 2007", 7 pgs.

"U.S. Appl. No. 10/857,599, Response filed Apr. 30, 2009 to Non-Final Office Action mailed Dec. 31, 2008", 7 pgs.

"U.S. Appl. No. 10/857,599, Response filed Nov. 12, 2009 to Final Office Action mailed Jun. 11, 2009", 9 pgs.

"U.S. Appl. No. 10/857,599, Response filed Nov. 16, 2007 to Restriction Requirement dated May 21, 2007", 6 pgs.

"U.S. Appl. No. 10/857,599, Response filed Nov. 24, 2008 to Final Office Action mailed Jul. 24, 2008", 9 pgs.

"U.S. Appl. No. 10/857,599, Restriction Requirement mailed May 21, 2007", 5 pgs.

"U.S. Appl. No. 11/276,763, Decision on Pre-Appeal Brief Request mailed Feb. 15, 2011", 3 pgs.

"U.S. Appl. No. 11/276,763, Final Office Action mailed Sep. 14, 2010", 9 pgs.

"U.S. Appl. No. 11/276,763, Non-Final Office Action mailed Apr. 2, 2010", 11 pgs.

"U.S. Appl. No. 11/276,763, Notice of Allowance mailed Aug. 25, 2011", 8 pgs.

"U.S. Appl. No. 11/276,763, Pre-Appeal Brief Request filed Jan. 14, 2011", 5 pgs.

"U.S. Appl. No. 11/276,763, Response filed Jan. 11, 2010 to Restriction Requirement mailed Dec. 10, 2009", 9 pgs.

"U.S. Appl. No. 11/276,763, Response filed Jun. 15, 2011 to Final Office Action mailed Sep. 14, 2010", 10 pgs.

"U.S. Appl. No. 11/276,763, Response filed Jul. 2, 2010 to Non Final Office Action mailed Apr. 2, 2010", 15 pgs.

"U.S. Appl. No. 11/276,763, Restriction Requirement mailed Dec. 10, 2009", 6 pgs.

"U.S. Appl. No. 11/877,567, Non Final Office Action mailed Sep. 1, 2011", 17 pgs.

"U.S. Appl. No. 11/877,605 , Response filed Jan. 27, 2012 to Non Final Office Action mailed Sep. 27, 2011", 10 pgs.

"U.S. Appl. No. 11/877,605, Non Final Office Action mailed Sep. 27, 2011", 12 pgs.

"U.S. Appl. No. 11/877,606, Examiner Interview Summary mailed Feb. 8, 2012", 1 pg.

"U.S. Appl. No. 11/877,606, Final Office Action mailed Dec. 2, 2011", 11 pgs.

"U.S. Appl. No. 11/877,606, Non Final Office Action mailed Jun. 10, 2011", 12 pgs.

"U.S. Appl. No. 11/877,606, Notice of Allowance mailed Feb. 15, 2012", 10 pgs.

"U.S. Appl. No. 11/877,606, Response filed Feb. 2, 2012 to Final Office Action mailed Dec. 2, 2011", 9 pgs.

"U.S. Appl. No. 11/877,606, Response filed Sep. 12, 2011 to Non-Final Office Action mailed Jun. 10, 2011", 7 pgs.

"U.S. Appl. No. 12/336,460, Non Final Office Action mailed Sep. 29, 2011", 13 pgs.

"U.S. Appl. No. 12/336,460, Response filed Jan. 30, 2012 to Non Final Office Action mailed Sep. 29, 2011", 25 pgs.

"U.S. Appl. No. 12/875,646, Non Final Office Action mailed Jan. 30, 2012", 4 pgs.

"European Application Serial No. 07250899.7, European Search Report mailed May 15, 2008", 7 pgs.

"European Application Serial No. 07250899.7, Office Action Mailed Jan. 15, 2009", 1 pgs.

"European Application Serial No. 07250899.7, Office Action mailed Mar. 21, 2011", 3 pgs.

"European Application Serial No. 07250899.7, Response to Official Communication Filed Jul. 13, 2009", 17 pgs.

"European Application Serial No. 07839767.6, Office Action mailed May 5, 2011", 4 pgs.

"European Application Serial No. 07839767.6, Response filed Jun. 2, 2011 to Office Action mailed May 5, 2011", 11 pgs.

"European Application Serial No. 07839768.4, Office Action Received Dec. 9, 2011", 3 pgs.

"International Application Serial No. PCT/US2007/022548, International Preliminary Report on Patentability mailed May 7, 2009", 8 pgs.

"International Application Serial No. PCT/US2007/022548, Search Report mailed Jun. 3, 2008", 7 pgs.

"International Application Serial No. PCT/US2007/022548, Written Opinion mailed Jun. 3, 2008", 8 pgs.

"International Application Serial No. PCT/US2007/022549, International Preliminary Report on Patentability mailed May 7, 2009", 8 pgs.

"International Application Serial No. PCT/US2007/022549, International Search Report and Written Opinion mailed Feb. 15, 2008", 12 pgs.

"International Application Serial No. PCT/US2007/022550, International Preliminary Report on Patentability mailed May 7, 2009", 8 pgs.
"International Application Serial No. PCT/US2007/022550, International Search Report and Written Opinion mailed Oct. 23, 2006", 12 pgs.
Beaufays, Francoise, "Transform-Domain Adaptive Filters: An Analytical Approach", IEEE Trans. on Signal Proc., vol. 43(2), (Feb. 1995), 422-431.
Chankawee, A., et al., "Performance improvement of acoustic feedback cancellation in hearing aids using liner prediction", Digital Signal Processing Research Laboratory(DSPRL), (Nov. 21, 2004), 116-119.
Maxwell, J. A., et al., "Reducing Acoustic Feedback in Hearing Aids", IEEE Transactions on Speech and Audio Processing, 3(4), (Jul. 1995), 304-313.
Proakis, J. G, et al., "Digital Signal Processing", Prentice-Hall, Inc., XP002481168, (1996), 213-214—p. 536.
Rife, D., et al., "Transfer-Function Measurement With Maximum-Length Sequences", J. Audio Eng. Soc., 37(6), (1989), 419-444.
Theverapperuma, Lalin S, et al., "Adaptive Feedback Canceller: Entrainment", Digital Signal Processing Workshop, 4TH IEEE, PI, (Sep. 1, 2006), 245-250.
Theverapperuma, Lalin S, et al., "Continuous Adaptive Feedback Canceller Dynamics", Circuits and Systems, 49th IEEE International Midwes T Symposium On, IEEE, PI, (Aug. 1, 2006), 605-609.
Wong, T.W., et al., "Adaptive Filtering Using Hartley Transform and Overlap-Saved method", IEEE Transaction on Signal Processing, vol. 39, No. 7, (Jul. 1991), 1708-1711.
"U.S. Appl. No. 11/877,567, Notice of Allowance mailed May 31, 2012", 11 pgs.
"U.S. Appl. No. 11/877,605, Response filed Jul. 9, 2012 to Final Office Action mailed Apr. 9, 2012", 9 pgs.
"U.S. Appl. No. 11/877,605, Final Office Action mailed Apr. 9, 2012", 17 pgs.
"U.S. Appl. No. 12/336,460 , Response filed Jun. 27, 2012 to Final Office Action mailed Apr. 27, 2012", 10 pgs.
"U.S. Appl. No. 12/336,460, Advisory Action mailed Jul. 30, 2012", 3 pgs.
"U.S. Appl. No. 12/336,460, Final Office Action mailed Apr. 27, 2012", 8 pgs.
"U.S. Appl. No. 12/875,646, Response filed Jul. 30, 2012 to Non Final Office Action mailed Jan. 30, 2012", 7 pgs.
"European Application Serial No. 07839768.4, Response filed Apr. 5, 2012 to Office Action mailed Dec. 9, 2011", 20 pgs.
U.S. Appl. No. 11/877,567, Notice of Allowance mailed Sep. 28, 2012, 8 pgs.
U.S. Appl. No. 11/877,605, Non Final Office Action mailed Nov. 20, 2012, 8 pgs.
U.S. Appl. No. 12/336,460, Non Final Office Action mailed Nov. 26, 2012, 6 pgs.
U.S. Appl. No. 12/875,646, Final Office Action mailed Oct. 25, 2012, 10 pgs.
European Application Serial No. 07839766.8, Office Action mailed Sep. 17, 2012, 10 pgs.
Spreiet, Ann, et al., "Adaptive Feedback Cancellation in Hearing Aids With Linear Prediction of the Desired Signal", IEEE Transactions on Signal Processing 53(10), (Oct. 2005), 3749-3763.
Theverapperurna, Lalin S, et al., "Adaptive Feedback Canceller: Entrainment", Digital Signal Processing Workshop, 12th—Signal Processing Education Workshop, 4th, IEEE, (2006), 245-250.

* cited by examiner

ENTRAINMENT AVOIDANCE WITH A GRADIENT ADAPTIVE LATTICE FILTER

CLAIM OF PRIORITY AND RELATED APPLICATION

This application claims the benefit under 35 U.S.C. 119(e) of U.S. Provisional Patent Application Ser. No. 60/862,533, filed Oct. 23, 2006, the entire disclosure of which is hereby incorporated by reference in its entirety.

TECHNICAL FIELD

The present subject matter relates generally to adaptive filters and in particular to method and apparatus to reduce entrainment-related artifacts for adaptive filters.

BACKGROUND

Digital hearing aids with an adaptive feedback canceller usually suffer from artifacts when the input audio signal to the microphone is periodic. The feedback canceller may use an adaptive technique, such as a N-LMS algorithm, that exploits the correlation between the microphone signal and the delayed receiver signal to update a feedback canceller filter to model the external acoustic feedback. A periodic input signal results in an additional correlation between the receiver and the microphone signals. The adaptive feedback canceller cannot differentiate this undesired correlation from that due to the external acoustic feedback and borrows characteristics of the periodic signal in trying to trace this undesired correlation. This results in artifacts, called entrainment artifacts, due to non-optimal feedback cancellation. The entrainment-causing periodic input signal and the affected feedback canceller filter are called the entraining signal and the entrained filter, respectively.

Entrainment artifacts in audio systems include whistle-like sounds that contain harmonics of the periodic input audio signal and can be very bothersome and occurring with day-to-day sounds such as telephone rings, dial tones, microwave beeps, instrumental music to name a few. These artifacts, in addition to being annoying, can result in reduced output signal quality. Thus, there is a need in the art for method and apparatus to reduce the occurrence of these artifacts and hence provide improved quality and performance.

SUMMARY

This application addresses the foregoing needs in the art and other needs not discussed herein. Method and apparatus embodiments are provided for a system to avoid entrainment of feedback cancellation filters in hearing assistance devices. Various embodiments include using a gradient adaptive lattice filter to measure an acoustic feedback path and monitoring the gradient adaptive lattice filter for indications of entrainment. Various embodiments include comparing a time adjusted forward error across stages of the gradient adaptive lattice filter to a threshold for the indication of entrainment of the gradient adaptive lattice filter. Various embodiments include suspending adaptation of the gradient adaptive lattice filter upon indication of entrainment.

Embodiments are provided that include a microphone, a receiver and a signal processor to process signals received from the microphone, the signal processor including an adaptive feedback cancellation filter, the adaptive feedback cancellation filter adapted to provide an estimate of an acoustic feedback path for feedback cancellation. Various embodiments include a gradient adaptive filter with one or more reflection coefficients and a signal processor programmed to compare at least one of the one or more reflection coefficients to a threshold for indication of entrainment of the gradient adaptive lattice filter. Various embodiments provided include a signal processor programmed to suspend the adaptation of the gradient adaptive filter upon an indication of entrainment of the gradient adaptive filter.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their legal equivalents.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Figure 1:
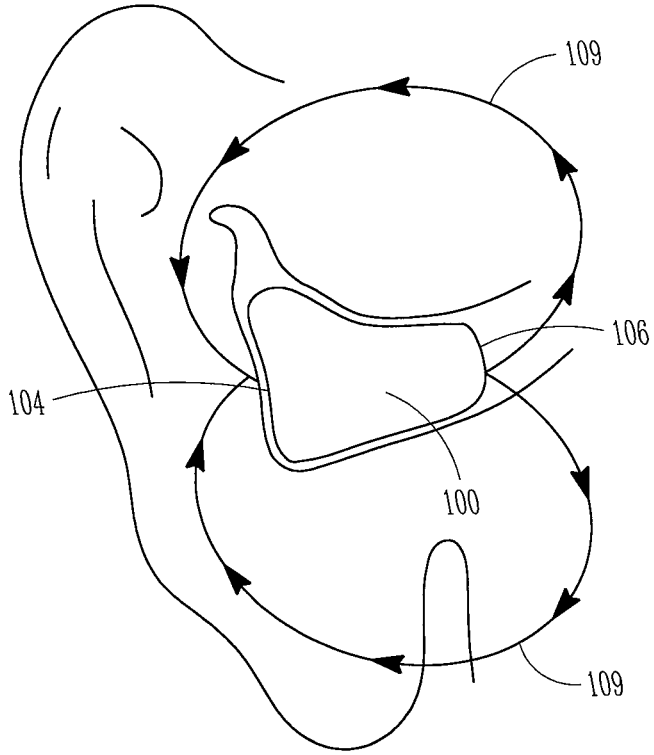
FIG. 1 is a diagram demonstrating, for example, an acoustic feedback path for one application of the present system relating to an in the ear hearing aid application, according to one application of the present system.

FIG. 1 is a diagram demonstrating, for example, an acoustic feedback path for one application of the present system relating to an in-the-ear hearing aid application, according to one embodiment of the present system. In this example, a hearing aid 100 includes a microphone 104 and a receiver 106. The sounds picked up by microphone 104 are processed and transmitted as audio signals by receiver 106. The hearing aid has an acoustic feedback path 109 which provides audio from the receiver 106 to the microphone 104. It is understood that the invention may be applied to a variety of other systems, including, but not limited to, behind-the-ear hearing systems, in-the-canal and completely-in-the canal hearing systems, hearing systems incorporating prescriptive hearing assistance programming and variations thereof.

Figure 2:
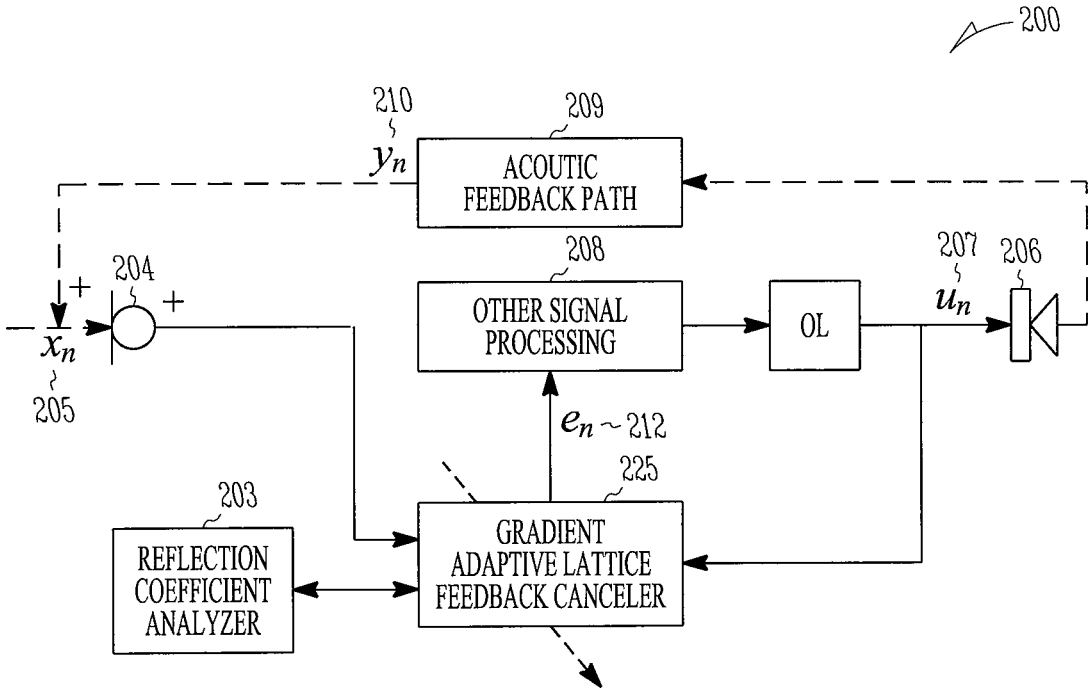
FIG. 2 illustrates an acoustic system with a gradient adaptive lattice feedback cancellation filter according to one embodiment of the present subject matter.

FIG. 2 illustrates an acoustic system 200 with a gradient adaptive lattice feedback cancellation filter 225 according to one embodiment of the present subject matter. FIG. 2 also includes a input device 204, such as a microphone, an output device 206, such as a speaker, processing electronics 208 for processing and amplifying a compensated input signal $e_n$ 212, an acoustic feedback path 209 with acoustic feedback path signal $y_n$ 210. In various embodiments, the adaptive feedback cancellation filter 225 mirrors the feedback path 209 transfer function and signal $y_n$ 210 to produce a compensated input signal $e_n$ 212 containing minimal, if any, feedback path 209 components. In one example, the gradient adaptive lattice feedback cancellation filter 225 includes processing to separate the input to the filter into a forward prediction error component and a backward prediction error components to assist in detecting entrainment of the gradient adaptive lattice feedback cancellation filter 225. The gradient adaptive lattice feedback cancellation filter 225 combines the forward and backward prediction components of the system output signal $u_n$ 207 with the input signal $x_n$ 205 to cancel most, if not all, the $y_n$ 210 components within in the input signal $x_n$ 205 resulting from the feedback path 209. FIG. 2 also shows a reflection coefficient analyzer 203. The reflection coefficient analyzer monitors the value of reflection coefficients of the gradient adaptive lattice feedback cancellation filter 225 for indications of entrainment. Upon indication of entrainment, the reflection coefficient analyzer modulates the adaptation of the gradient adaptive lattice feedback cancellation filter 225 to eliminate entrainment artifacts from the system output signal $u_n$ 207.

Figure 4A:
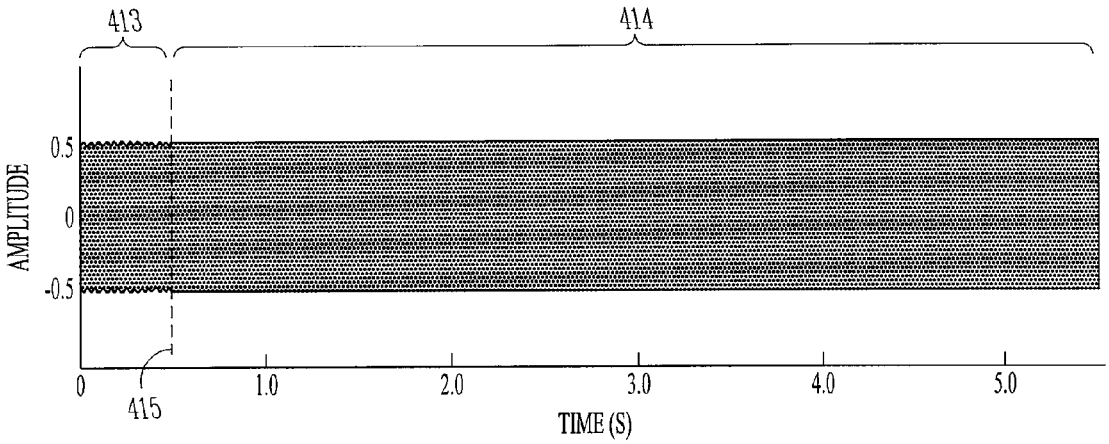
FIGS. 4A-C illustrate the response of an adaptive feedback system using a gradient adaptive lattice feedback cancellation filter according one embodiment of the present subject matter, but without modulating the adaptation of the gradient adaptive lattice feedback cancellation filter in light of indicated entrainment.
Figure 4B:
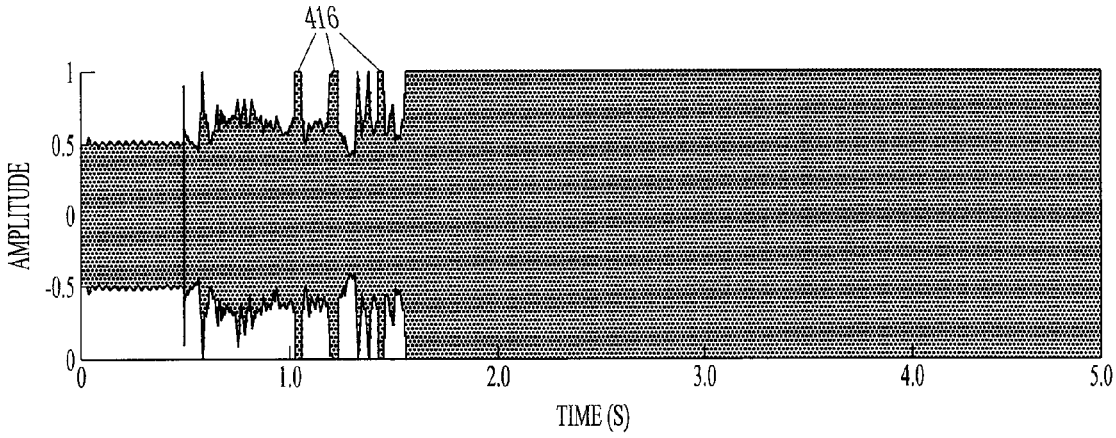
Figure 4C:
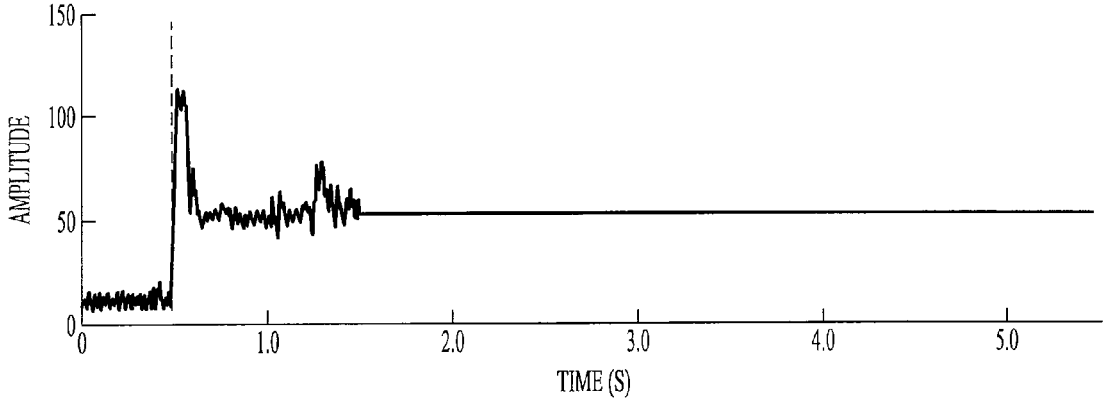

FIGS. 4A-C illustrate the response of an adaptive feedback system using a gradient adaptive lattice feedback cancellation filter according one embodiment of the present subject matter, but without modulating the adaptation of the gradient adaptive lattice feedback cancellation filter in light of indicated entrainment. The input to the system includes a interval of white noise 413 followed by interval of tonal input 414 as illustrated in FIG. 4A. FIG. 4B illustrates the output of the system in response to the input signal of FIG. 4A. As expected, the system's output tracks the white noise input signal during the initial interval 413. When the input signal changes to a tonal signal at 415, FIG. 4B shows the system is able to output an attenuated signal for a short duration before the adaptive feedback begins to entrain to the tone and pass entrainment artifacts 416 to the output. The entrainment artifacts are illustrated by the periodic amplitude swings in the output response of FIG. 4B. FIG. 4C shows the sum of the reflection coefficients of the gradient adaptive lattice feedback cancellation filter in response to the input signal of FIG. 4A. During the white noise interval the sum of the reflection coefficients remain relatively small compared to the sum during the tonal interval of the input signal.

In some embodiments, order recursive structures may be used in FPGA and VLSI implementation of feedback cancellers due to their modularity and lattice like structure, which may be key features for ease of implementation. In addition, they are immune to finite word length instabilities. Gradient adaptive lattice (GAL) filters are a type of order recursive lattice structures used for predicting and noise cancellation. GAL algorithms have a built in de-correlative property and, therefore, perform well in the presence of correlated input signals. In various embodiments, this de-correlative property is exploited to avoid entrainment in systems by modifying the gradient adaptive lattice filter. Entrainment avoidance is accomplished using a GAL to determine magnitude of the reflection coefficients, which is an indication of entraining behavior. Evaluating the coefficient magnitudes against a threshold or threshold formula allows a signal processor to change the adaptation rate to avoid entrainment. From a computational view point, using GAL structures for non-entraining feedback cancellers is attractive. These algorithms have superior convergence behavior compared to traditional LMS algorithms.

Figure 3:
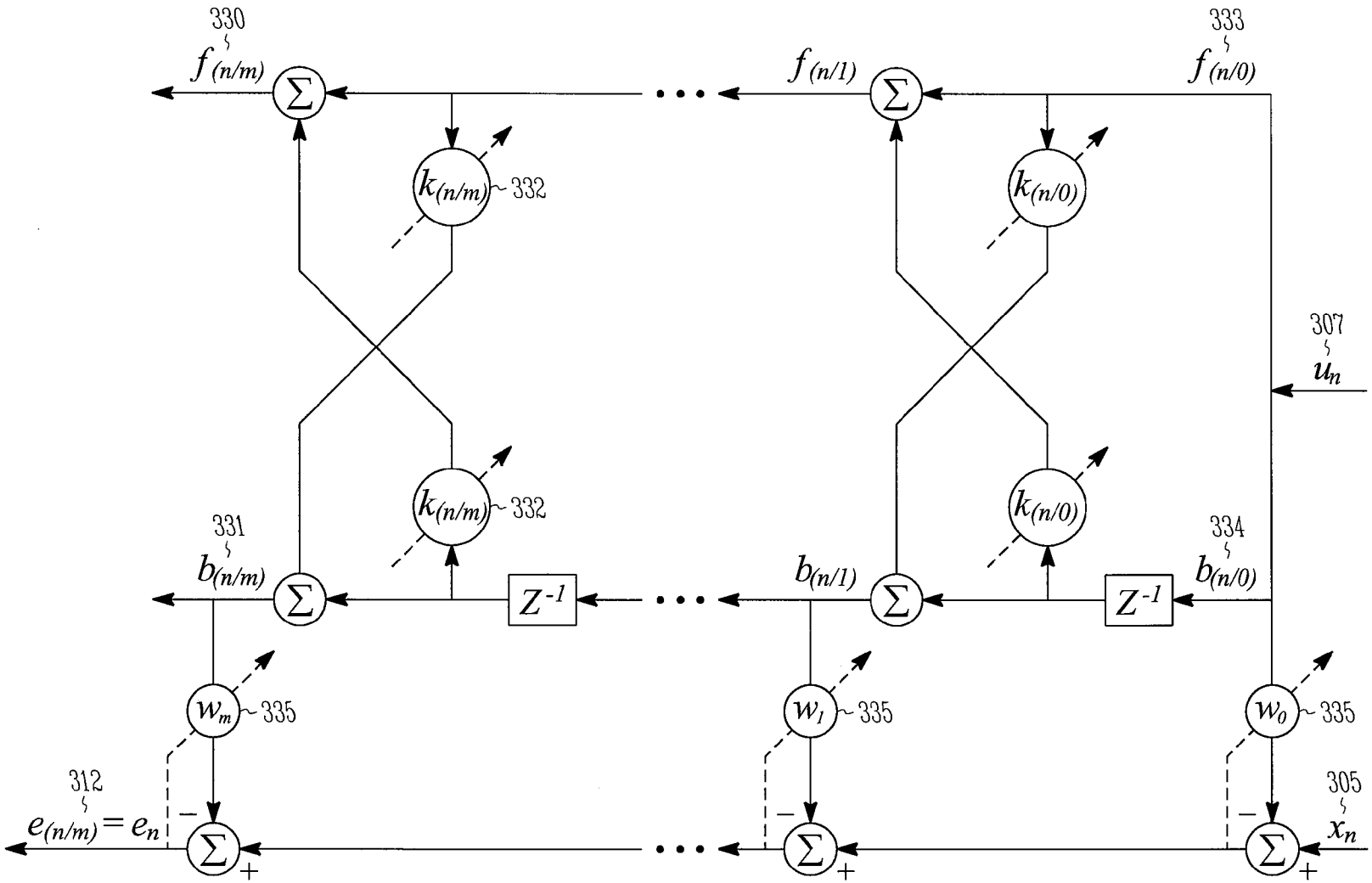
FIG. 3 illustrates a gradient adaptive lattice filter according to one embodiment of the present subject matter.

The basic principle of GAL algorithms is to select an estimate for the reflection coefficient that minimizes the sum of the mean-square forward and backward residuals at the output of the $m^{th}$ stage. The optimum reflection coefficient of the $m^{th}$ stage of lattice predictor is obtained by minimizing the cost function, $$J_m = E\{f_{n|m}|^2 + |b_{n|m}|^2\}$$

where $f_{n|m}$ 330 is the forward predictor error at time n and $b_{n|m}$ 331 is the backward predictor error, both at the output of the $m^{th}$ stage as shown in FIG. 3. The stages are related by, $$f_{n|m} = f_{(n|m-1)} + \kappa_{n|m} b_{(n|m-1)},$$

and $$b_{n|m} = b_{(n|m-1)} + \kappa_{n|m} f_{(n|m-1)}$$

where $\kappa_{n|m}$ 332 is the reflection coefficient of stage m. The input to the system can be considered as the zeroth-order forward and backward prediction errors, and the initialization for above recursions is given by $f_{n|0} = u_n$ 333 and $b_{n|0} = u_n$ 334 where $u_n$ 307 is the output of the feedback canceller or input to the GAL filter. Substituting the above stage equations into the above cost function, $$J_m = (E\{|f_{(n|m-1)}|^2\} + E\{|b_{(n-1|m-1)}|^2\})(1 + |\kappa_{(n|m)}|^2) + 4\kappa_{(n|m)} E\{f_{(n|m-1)} b_{(n-1|m-1)}\}.$$

Differentiating with respect to the reflection coefficient κ gives, $$\frac{\partial J_m}{\partial \kappa_{(n|m)}} = 2\kappa_{(n|m)}(E\{|f_{(n|m-1)}|^2\} + E\{|b_{(n-1|m-1)}|^2\}) + 4E\{f_{(n|m-1)} b_{(n-1|m-1)}\}$$

The gradient adaptive lattice (GAL) algorithm for minimization of the cost function $J_m$ is implemented according to the recursive equation, $$\kappa_{(n+1|m)} = \kappa_{(n|m)} - \frac{1}{2}\mu_n \frac{\partial J_m}{\partial \kappa_{(n|m)}}$$

by substitution, $$\kappa_{(n+1|m)} = \kappa_{(n|m)} - \mu_n \frac{f_{(n-1|m)} b_{(n|m)} + b_{(n-1|m-1)} f_m(n)}{\xi_{(n|m-1)}}$$

where $\xi_{(n|m-1)}$ is an estimation of energy given by, $$\xi_{(n|m-1)} = \sum_{i=1}^{n} (|f_{(n|m-1)}|^2 + |b_{(n-1|m-1)}|^2)$$

when $\kappa_m$ is a block estimate of the reflection coefficient. Alternatively, the energy estimate is derived as a one pole averaging filter of the prediction errors, $$\xi_{(n|m-1)} = \beta\xi_{(n-1|m-1)} + (1-B)(|f_{(n|m-1)}|^2 + |b_{(n-1|m-1)}|^2)$$

where β is the smoothing constant. The desired signal is estimated at each stage with error criteria of the stages, in other words, the desired signal 312 is estimated order recursively, $$e_{(n|m)} = y_n - \hat{y}_{(n|m)}$$

where $y_n$ is the feedback leakage signal and $\hat{y}_{(n|m)}$ is the output of the $m^{th}$ stage, which is given by, $$y_{(n|m)} = y_{(n|m-1)} - w_{(n|m)} b_{(n|m)}.$$

In a order recursive adaptive filtering algorithm, the reflection coefficients are updated directly from the error feedback built into the algorithm. The weight update 335 of the second stage is similar to a NLMS algorithm and it is given by, $$w_{(n+1|m)} = w_{(n|m)} + \frac{\mu}{\|B_{(n|m)}\|^2} b_{(n|m)} e_{(n|m)}$$

where μ is the weight and $B_{(n|m)}$ can be calculated order recursively, since $b_{(n|m)}$ of each stage is orthogonal to each other, $$\|B_{(n|m)}\|^2 = \|B_{(n|m-1)}\|^2 + |b_{(n|m)}|^2.$$

In various embodiments, entrainment avoidance is achieved by determining the magnitude of the reflection coefficients, or the time adjusted forward error across stages and evaluating the coefficients against a predetermined threshold or threshold formula. When a correlated input signal is presented to the system the lattice stage de-correlates the signal to orthogonal components. As a result of the correlation, the reflection coefficients become larger. For an uncorrelated input signal, the reflection coefficients remain small. In various embodiments, the coefficients are evaluated after applying a smoothing filter. In various embodiments, a one pole smoothening filter is used to avoid false detections. In various embodiments, analysis is divided into two stages, a lattice predictor following a NLMS algorithm. The lattice predictor de-correlates the signal and feeds to the NLMS stage. For white noise the predictor is unable to model the signal and the reflection coefficients are small. For correlated inputs the successive modes are modeled by the successive stages similar to Gram-Schmidt orthogonalization. The system identifies input signal correlation by evaluating the coefficients against a predetermined threshold determined by $$\kappa_n = \beta\kappa_{n-1} + \sum_{m=0}^{M-1} |\kappa_{(n|m)}|$$

and, $$\kappa_n \leq KM$$

where K is an empirical constant and M is the number of stages in the lattice. If the criteria is exceeded the adaptation is stopped. This condition is evaluated regularly to restore the adaptation of the system.

The forward prediction error is in turn related to the $\kappa_{(n|m)}$, since when $\kappa_{(n|m)} \approx 0$ the $f_{(n|M-1)} \approx f_{(n|M-2)}$ and $f_{(n|M-1)} \approx f_{(n|0)}$ by time delaying and averaging the difference in $f_{(n|m)}$, and by looking into the variance of f(n|m) enable the stopping of adaptation before entrainment.

Figure 5A:
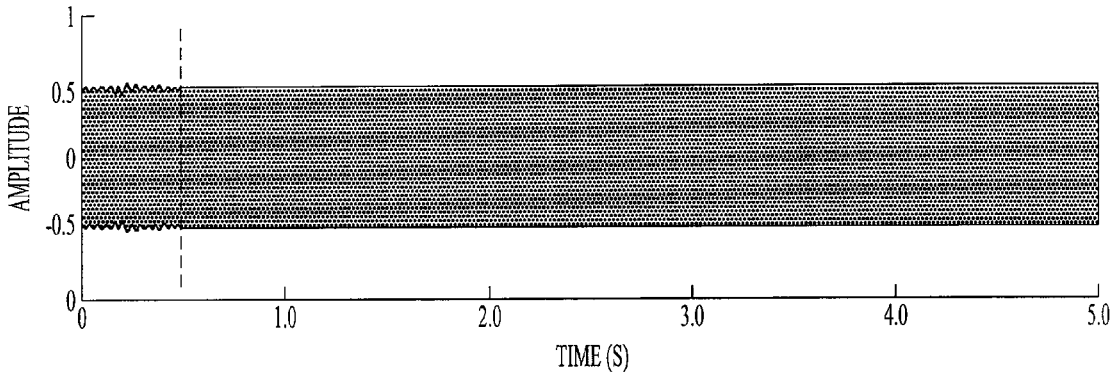
FIGS. 5A and 5B illustrates the response of the entrainment avoidance system embodiment of FIG. 2 using a reflection coefficient analyzer module of a signal processor to monitor and modulate the adaptation of a gradient adaptive lattice feedback cancellation filter.
Figure 5B:
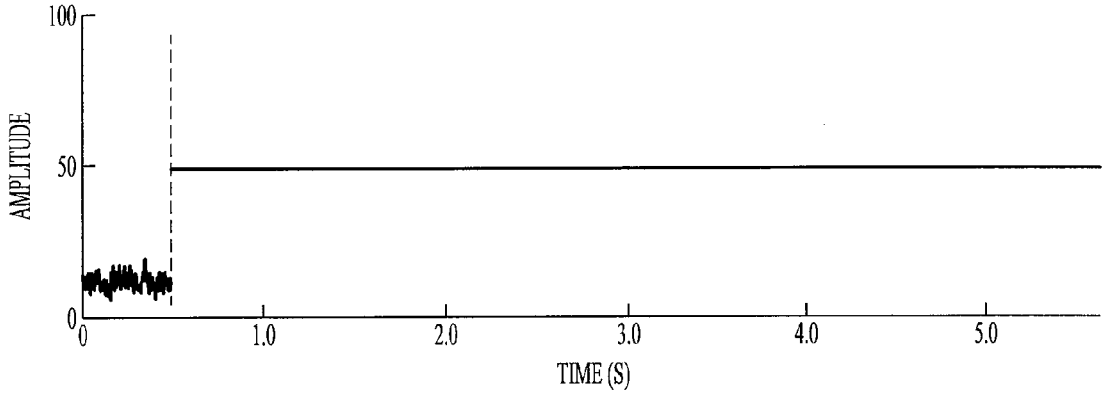

FIG. 5A illustrates the response of the entrainment avoidance system embodiment of FIG. 2 using a reflection coefficient analyzer module of a signal processor to monitor and modulate the adaptation of an gradient adaptive lattice feedback cancellation filter. In various embodiments, the reflection coefficient analyzer module is adapted to compare one or more reflection coefficients against a threshold. Upon an indication of entrainment, the reflection coefficient analyzer module modulates the adaptation of the gradient adaptive lattice feedback cancellation filter to eliminate entrainment artifacts from the output of the system. In various embodiments, the reflection coefficient analyzer module suspends adaptation updates of the gradient adaptive lattice feedback cancellation filter upon indication of entrainment. FIG. 5A shows the system outputting an interval of white noise followed by an interval of tonal signal closely replicating the input to the system represented by the signal illustrated in FIG. 4A. FIG. 5B illustrates a sum of reflection coefficients of the gradient adaptive lattice feedback cancellation filter. FIG. 5B shows that during the tonal input period, the sum of the reflection coefficients does deviate from the value measured during the white noise interval. However, because the reflection coefficient analyzer module modulates the adaptation of the gradient adaptive lattice feedback cancellation filter, the sum of the reflection coefficients do not fluctuate and diverge as extremely as in the FIG. 4C. As a result, FIG. 5A does not show entrainment peaks as entrainment artifacts are eliminated using the various embodiments of the present application subject matter. The results of FIGS. 5A-B were generated with a typical acoustic leakage path (22 tap) with a 16 tap DCT-LMS adaptive feedback canceller with eigenvalue control. Each data point is created by averaging 20 runs (N=20). Each audio file is 10 seconds in duration, 5 seconds of white noise followed by 5 seconds of tonal signal.

Figure 6:
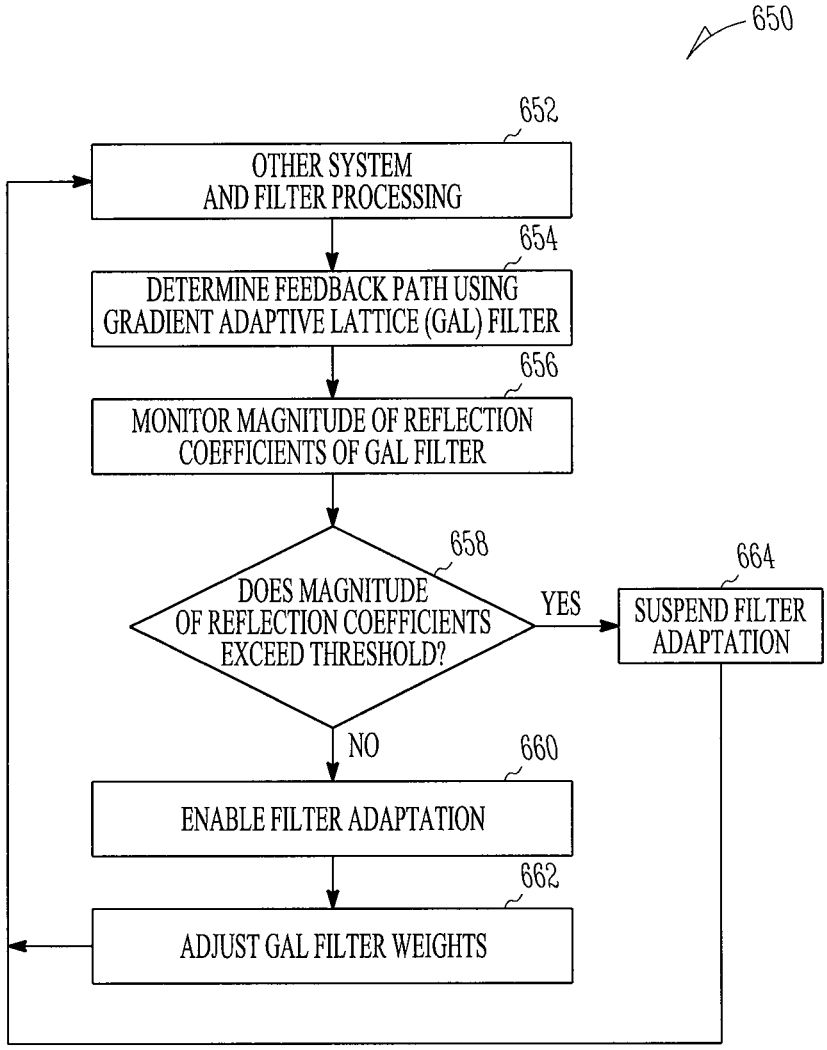
FIG. 6 illustrates a flow diagram of a method of entrainment avoidance according to one embodiment of the present subject matter.

FIG. 6 illustrates a flow diagram of a method of entrainment avoidance 650 according to one embodiment of the present subject matter. Various systems perform signal processing 652 associated with amplifying and processing digital audio signals of a hearing assistance device while monitoring and avoiding entrainment of a gradient adaptive lattice filter. In various embodiments, the gradient adaptive lattice filter is used to determine one or more time varying feedback paths of the acoustic system 654. As the gradient adaptive lattice filter adapts to the feedback paths, one or more reflection coefficients of the gradient adaptive lattice filter are monitored 656 for indications of entrainment of the filter. If no entrainment is identified 658, adaptation of the filter is enabled 660, in case it had been suspended, and the weight coefficients of the filter are updated 662 to accommodate cancelling feedback resulting from the identified feedback path. If entrainment is indicated, adaptation of the filter is suspended 664 until no entrainment is detected. It is understood that some variation in order and acts being performed are possible without departing from the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of equivalents to which such claims are entitled.

What is claimed is:

1. A method of signal processing an input signal in a hearing assistance device to avoid entrainment, the hearing assistance device including a receiver and a microphone, the method comprising:

using a gradient adaptive lattice filter including one or more reflection coefficients to measure an acoustic feedback path from the receiver to the microphone of the hearing assistance device; monitoring the gradient adaptive lattice filter including a comparison between a time adjusted forward error across stages of the gradient adaptive lattice filter and a predetermined threshold value for an indication of entrainment of the gradient adaptive lattice filter; and changing an adaptation rate of the gradient adaptive lattice filter to avoid entrainment.

2. The method of claim 1, further comprising comparing at least one or more of the reflection coefficients to the predetermined threshold value for the indication of entrainment of the gradient adaptive lattice filter.

3. The method of claim 1, further comprising modulating the adaptation of the gradient adaptive lattice filter if the monitoring indicates entrainment of the gradient adaptive lattice filter.

4. The method of claim 3, wherein modulating the adaptation of the gradient adaptive lattice filter upon indication of entrainment includes reducing the adaptation rate of the gradient adaptive lattice filter.

5. The method of claim 3, wherein modulating the adaptation of the gradient adaptive lattice filter upon indication of entrainment, includes suspending adaptation of the gradient adaptive lattice filter.

6. The method of claim 2, further comprising modulating the adaptation of the gradient adaptive lattice filter if the monitoring indicates entrainment of the gradient adaptive lattice filter.

7. The method of claim 6, wherein modulating the adaptation of the gradient adaptive lattice filter upon indication of entrainment includes reducing the adaptation rate of the gradient adaptive lattice filter.

8. The method of claim 6, wherein modulating the adaptation of the gradient adaptive lattice filter upon indication of entrainment, includes suspending adaptation of the gradient adaptive lattice filter.

9. An apparatus comprising:

a microphone, a signal processor to process signals received from the microphone, the signal processor including an adaptive feedback cancellation filter, the adaptive feedback cancellation filter adapted to provide an estimate of an acoustic feedback path for feedback cancellation; and a receiver adapted for emitting sound based on the processed signals, wherein the adaptive feedback cancellation filter includes a gradient adaptive lattice filter with one or more reflection coefficients, wherein the signal processor includes programming instructions to monitor entrainment of the gradient adaptive lattice filter including a comparison between a time adjusted forward error across stages of the gradient adaptive lattice filter and a predetermined threshold value for an indication of entrainment of the gradient adaptive lattice filter and to change an adaptation rate of the gradient adaptive lattice filter to avoid entrainment.

10. The apparatus of claim 9, wherein the signal processor further includes programing instructions to compare at least one or more of the reflection coefficients to the predetermined threshold value for the indication of entrainment of the gradient adaptive lattice filter.

11. The apparatus of claim 9, wherein the signal processor includes programing instructions to modulate adaptation of the gradient adaptive lattice filter upon the indication of entrainment of the gradient adaptive lattice filter.

12. The apparatus of claim 9, wherein the signal processor includes programing instructions for hearing improvement.

13. The apparatus of claim 9, further comprising a housing to enclose the signal processor.

14. The apparatus of claim 13, wherein the housing includes a behind-the-ear (BTE) housing.

15. The apparatus of claim 13, wherein the housing includes an in-the-canal (ITC) housing.

16. The apparatus of claim 13, wherein the housing includes a completely-in-the-canal (CIC) housing.

* * * * *

UNITED STATES PATENT AND TRADEMARK OFFICE

CERTIFICATE OF CORRECTION

PATENT NO. : 8,452,034 B2
APPLICATION NO. : 11/877317
DATED : May 28, 2013
INVENTOR(S) : Lalin Theverapperuma It is certified that error appears in the above-identified patent and that said Letters Patent is hereby corrected as shown below:

On the Title Page, Item (56)

On page 2, in column 1, under "Other Publications", line 4, delete "pg" and insert --pgs--, therefor On page 2, in column 1, under "Other Publications", line 13, delete "Mailed" and insert --mailed--, therefor On page 2, in column 1, under "Other Publications", line 32, delete "dated" and insert --mailed--, therefor On page 2, in column 2, under "Other Publications", line 25, delete "11/877,605 ," and insert --11/877,605,--, therefor On page 2, in column 2, under "Other Publications", line 49, delete "Mailed" and insert --mailed--, therefor On page 2, in column 2, under "Other Publications", line 50, delete "pgs" and insert --pg--, therefor On page 2, in column 2, under "Other Publications", line 54, delete "Filed" and insert --filed--, therefor On page 2, in column 2, under "Other Publications", line 60, delete "Received" and insert --mailed--, therefor On page 3, in column 1, under "Other Publications", line 17, delete "G," and insert --G.,--, therefor On page 3, in column 1, under "Other Publications", line 21, delete "S," and insert --S.,--, therefor On page 3, in column 1, under "Other Publications", line 22, delete "4TH" and insert --4th--, therefor Signed and Sealed this
Eleventh Day of November, 2014

Michelle K. Lee

Michelle K. Lee
*Deputy Director of the United States Patent and Trademark Office*

On page 3, in column 1, under “Other Publications”, line 24, delete “S,” and insert --S.,--, therefor On page 3, in column 1, under “Other Publications”, line 27, delete “T.W.,” and insert --T. W.,--, therefor On page 3, in column 1, under “Other Publications”, line 28, delete “Saved” and insert --save--, therefor On page 3, in column 2, under “Other Publications”, line 5, delete “12/336,460 ,” and insert --12/336,460,--, therefor On page 3, in column 2, under “Other Publications”, line 15, before “U.S.”, insert --“--, therefor On page 3, in column 2, under “Other Publications”, line 16, after “2012”, insert --”--, therefor On page 3, in column 2, under “Other Publications”, line 17, before “U.S.”, insert --“--, therefor On page 3, in column 2, under “Other Publications”, line 18, after “2012”, insert --”--, therefor On page 3, in column 2, under “Other Publications”, line 19, before “U.S.”, insert --“--, therefor On page 3, in column 2, under “Other Publications”, line 20, after “2012”, insert --”--, therefor On page 3, in column 2, under “Other Publications”, line 21, before “U.S.”, insert --“--, therefor On page 3, in column 2, under “Other Publications”, line 21, after “2012”, insert --”--, therefor On page 3, in column 2, under “Other Publications”, line 23, before “European”, insert --“--, therefor On page 3, in column 2, under “Other Publications”, line 24, after “2012”, insert --”--, therefor On page 3, in column 2, under “Other Publications”, line 28, delete “S,” and insert --S.,--, therefor In the Claims In column 7, line 21, in Claim 1, after “device;”, insert --¶--, therefor